United States Patent [19]

Feldman

[11] Patent Number: 4,993,345

[45] Date of Patent: Feb. 19, 1991

[54] FLOATING DEGAUSSING CABLE SYSTEM

[75] Inventor: David W. Feldman, Panama City, Fla.

[73] Assignee: The United States of America as represented by the Secretary of the Navy, Washington, D.C.

[21] Appl. No.: 237,546

[22] Filed: Feb. 17, 1981

[51] Int. Cl.[5] ..... B63G 9/00

[52] U.S. Cl. ..... 114/240 R; 114/240 D

[58] Field of Search ..... 114/240 R, 240 D, 242, 114/221 R; 174/101.5

[56] References Cited

U.S. PATENT DOCUMENTS

| | | | |
|---|---|---|---|
| 2,395,056 | 2/1946 | Luby | 114/240 R |
| 2,419,053 | 4/1947 | Bennett | 114/240 R X |
| 2,967,506 | 1/1961 | Livermore | 114/240 R X |

*Primary Examiner*—David H. Brown

*Attorney, Agent, or Firm*—Sol Sheinbein; John Becker; Harvey David

[57] ABSTRACT

A system for degaussing ships includes a floating cable having a plurality of insulated conductors, the cable extending between a barge at one end and an end float at the other end, with a floating saddle member mounted at the mid-portion for engagement by a ship's bow. The cable ends are brought together at the barge, the conductors connected in series with one another and energized by a generator on the barge.

12 Claims, 1 Drawing Sheet

FLOATING DEGAUSSING CABLE SYSTEM

BACKGROUND OF THE INVENTION

This invention relates generally to the field of ship protection against mines, and more particularly to a novel and useful apparatus for protecting ships, that are not otherwise equipped with an on-board degaussing system, from magnetic influence mines during travel through known or suspected minefields.

Military ships are generally provided with on-board degaussing systems at the time they are built. Such on-board systems comprise electrical cables installed within the ship hull to form large coil loops and means for energizing the loops with electrical currents in a manner that will produce, as closely as possible, a magnetic field around the ship that will appear to magnetic influence mines as an undisturbed earth field. Examples of such on-board systems are found in U.S. Pat. Nos. 2,421,583; 12,730,063; 2,933,059; and 3,110,282.

During wartime or other national emergencies, it is often necessary to utilize merchant and other steel ships or vessels that were not designed or built with military service in mind, and so were not equipped with on-board degaussing system, for purposes which would expose them to the hazards of a minefield including magnetic mines. Such minefields are generally found in approaches to seaports and harbors rather than in the open sea.

Because the installation of on-board, permanently installed, degaussing systems on existing ships would be extremely expensive and would take such ships out of service for considerable periods of time and at a time when most needed, it would be of great benefit to have available a protective system that could be stored until needed and then used during the portions of a voyage where the dangers are most likely to exist.

SUMMARY OF THE INVENTION

With the foregoing in mind, it is a principal object of this invention to provide a ship degaussing system that is readily applied to existing ships, without removing the vessels from service.

Another object is to provide a relatively inexpensive, reliable, and reusuable degaussing system that can be used to protect a ship during travel through known or suspected minefields, for example at approaches to, or in, harbors and seaports.

As another object, the invention aims to provide a degaussing system, for temporary uses, that can be readily stored either aboard the ship of use, or other ships, and deployed near the point of entry to the danger area.

Still another object is the provision of an electrical degaussing system of the foregoing character that can be quickly applied or removed either by a ship's own crew or by a team stationed for those purposes at the locations where the needs exist.

A further object is to provide a ship degaussing system that can be used repeatedly and can be applied to a variety of vessels of differing dimensions.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
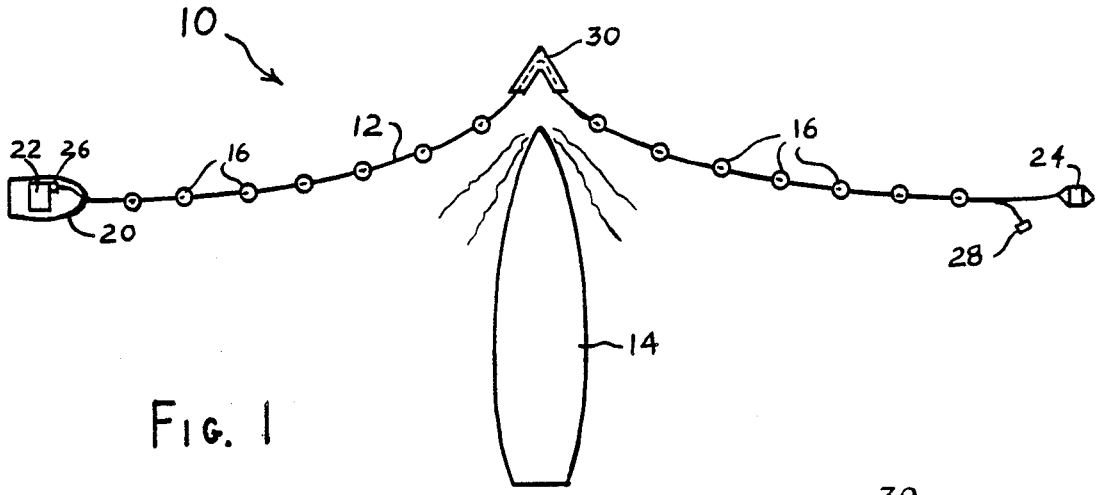
FIG. 1 is a plan view of a ship to be protected and of a degaussing system embodying the invention in their relative positions just prior to engagement of the degaussing system by the bow of the ship.
Figure 2:
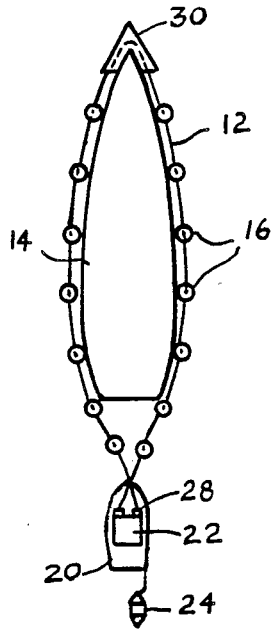
FIG. 2 is a plan view illustrating the ship and the degaussing system with the latter in operating position.

Referring to FIG. 1, a floating degaussing cable system according to this invention is generally indicated at 10 and comprises an insulated, electrically conductive cable 12 of a length that somewhat exceeds the waterline perimeter of a ship 14 to be protected against magnetic influence mines. The cable 12, which may have one or more conductors, has the capability of floating, either because of being constructed with a core or layer of flotation material or because of the addition of a plurality of discrete floats 16 positioned therealong. The latter flotation method provides the advantage of protection to the cable from chaffing, abrasion, etc., while the former offers the advantage of reduced hydrodynamic drag.

The cable 12 is secured at or near one end to a small boat or self-propelled propelled barge 20 that carries an electric current source 22, conveniently in the form of a motor driven generator, capable of providing a direct electric current of sufficient amperage to effect the desired magnetic field. At or near the other end of the cable 12 is tethered a float 24 that is somewhat larger than the floats 16. Conductors of the cable are conveniently terminated at their opposite ends in connectors 26 and 28 for a purpose that will become apparent as the description proceeds.

At or near the middle of the length of the cable 12 is fixed a floating saddle member 30 that is adapted to be engaged by the bow or stem 32 of the ship 14. The saddle member 30 is conveniently vee-shaped to facilitate such engagement.

When it is desired to deploy the degaussing system 10 for the protection of a ship 14 about to enter an area of concern, the cable 12 is laid out by being towed into a position across the track of the ship 14 and with the saddle member 30 directly in its path. As the slowly moving ship engages and pushes the saddle at the middle of the cable 12, the barge 20 and float 24 provide drag for the ends of the floating cable causing it to stream aft along opposite sides of the ship and to the rear thereof. The barge crew then picks up the terminal connector 28 and brings it aboard for connection to the electric current source.

Figure 3:
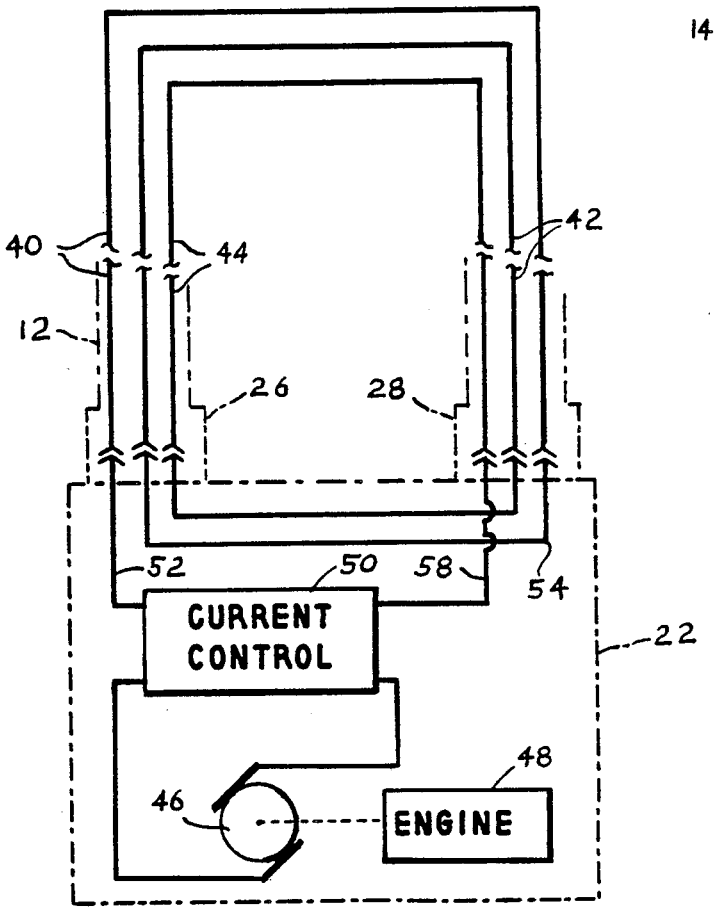
FIG. 3 is a diagrammatic view illustrating a multiple conductor cable and the manner of connecting it to form a plural loop degaussing coil.

Referring now to FIG. 3, the cable 12 is illustrated as having three conductors 40, 42, and 44 terminating in the connectors 26 and 28. It will be understood, of course, that more or fewer conductors could be used without departing from the scope of the invention. The electric current source 22 comprises a direct current generator 46 driven by a diesel or other engine 48 and providing its electrical input to a current control 50. The control 50 may comprise any of a variety of known means for reversing, or otherwise varying or not varying the level of the electric current to be applied to the cable. With the connectors 26, 28 in place, a plural loop circuit can be traced from the control 50 conductor 52 through cable conductor 40, conductor 54 cable conductor 42, conductor 56, cable conductor 44, and conductor 58 to the control 50. It will be understood, of course, that in a more simple embodiment the invention contemplates omission of the control 50 and electrical connection of the cable conductor or conductors directly to the output of the generator 46.

When the ship has completed transit of the zone requiring need for degaussing protection, the ship is stopped and the system is readily removed by disconnection of connector 28, and towing away of the system 10 by means of its self-propelled barge.

It is further contemplated that the electric current source may be carried on board the vessel to be protected rather than on the barge 20, and in fact may be part of the existing ship electrical system.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A system for degaussing a ship having a predetermined waterline perimeter, said system comprising:

a cable comprising insulated electrical conductor means extending from one end to the other and comprising flotation means for supporting said cable in a floating condition, said cable being longer than said waterline perimeter of sad ship;

barge means connected to one end portion of said cable whereby said cable can be deployed in said floating condition about said ship with the opposite end portions of said cable being brought substantially together aboard said barge; and current source means for energizing said conductor means when said cable is deployed about said ship as a degaussing coil.

2. A system as defined in claim 1, and wherein:

said current source means comprises electrical generator means aboard said barge means.

3. A system as defined in claim 2, and wherein:

said conductor means comprises a plurality of parallel conductors in said cable; and one end of one of said conductors and one end of another of said conductors are electrically connected together aboard said barge, and the other end of said one of said conductors and the other end of said another of said conductors being electrically connected to said current source means, whereby a plural loop degaussing coil is formed about said ship.

4. A system as defined in claim 3, and wherein:

said current source means further comprises control means, coupling said generator means to said conductor means, for varying the level of electrical energization of said coil.

5. A system as defined in claim 4, and wherein:

said flotation means comprises a plurality of flotation elements distributed along the length of said cable.

6. A System as defined in claim 5, and further comprising:

an end float member connected by tether means to the other end of said cable.

7. A system as defined in claim 6, and wherein:

said barge is self-propelled and operative to tow said cable for positioning thereof across the path of said ship during installation of said system and for towing said cable away from said ship during removal of said system.

8. A system as defined in claim 7, and further comprising:

a saddle member mounted on the mid-portion of said cable and engageable by the bow of said ship, whereby forward motion of said ship and drag by said barge and said end float member cause said cable to stream aft along opposite sides of said ship.

9. A system for degaussing a ship having a predetermined waterline perimeter, said system comprising:

a cable comprising insulated electrical conductor means and having flotation means for supporting said cable in a floating condition, said cable being longer than said waterline perimeter of said ship; a self-propelled barge connected to one end portion of said cable; an end float connected to the other end portion of said cable; said barge and said end float providing hydrodynamic drag whereby pushing of the mid-portion off said cable by the bow of said ship causes said cable to stream aft on opposite sides of said ship; an electrical current source mounted on said barge; connector means for connecting said conductor means to said current source for energization as a degaussing coil about said ship.

10. A system as defined in claim 9, and wherein:

said cable comprises a saddle float member mounted on said cable at the mid-portion thereof and characterized by a vee-shaped recess for engagement by the bow of said ship.

11. A system as defined in claim 10, and wherein:

said conductor means comprises a plurality of discrete conductors in said cable; and said conductors being connected in series with one another and with said current source, whereby a plural turn degaussing coil is formed about said ship.

12. A system as defined in claim 11, and further comprising:

means for controllably varying the electrical output of said current source to said conductors.

* * * * *